US008045880B2

(12) United States Patent
Hirose

(10) Patent No.: US 8,045,880 B2
(45) Date of Patent: Oct. 25, 2011

(54) SHEET FEEDING DEVICE AND IMAGE FORMING APPARATUS

(75) Inventor: Atsuo Hirose, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 100 days.

(21) Appl. No.: 12/334,802

(22) Filed: Dec. 15, 2008

(65) Prior Publication Data

US 2009/0160120 A1 Jun. 25, 2009

(30) Foreign Application Priority Data

Dec. 25, 2007 (JP) ..... 2007-331606

(51) Int. Cl.
*G03G 21/00* (2006.01)

(52) U.S. Cl. ..... 399/98; 399/358; 399/123; 399/34

(58) Field of Classification Search ..... 399/98, 399/123, 34, 358
See application file for complete search history.

(56) References Cited

U.S. PATENT DOCUMENTS

| | | | | |
|---|---|---|---|---|
| 4,181,425 | A * | 1/1980 | Higaya et al. | 399/358 |
| 4,659,212 | A * | 4/1987 | Ichihara et al. | 399/358 |
| 5,107,305 | A * | 4/1992 | Charland et al. | 399/360 |
| 6,708,009 | B2 * | 3/2004 | Fuwazaki et al. | 399/98 |
| 7,149,455 | B2 * | 12/2006 | Hattori | 399/98 |
| 7,149,456 | B2 * | 12/2006 | Yamagata | 399/98 |
| 7,181,156 | B2 * | 2/2007 | Kabata et al. | 399/351 |
| 7,646,995 | B2 * | 1/2010 | Kim et al. | 399/35 |
| 2008/0170898 | A1 * | 7/2008 | Shimizu et al. | 399/350 |

FOREIGN PATENT DOCUMENTS

| | | |
|---|---|---|
| JP | 2002-108153 | 4/2002 |
| JP | 2004-348005 | 12/2004 |
| JP | 2006-008386 | 1/2006 |
| JP | 2006-248652 | 9/2006 |

* cited by examiner

*Primary Examiner* — Stefanos Karmis
*Assistant Examiner* — Luis A Gonzalez
(74) *Attorney, Agent, or Firm* — Banner & Witcoff, Ltd

(57) ABSTRACT

A sheet feeding device to feed a sheet in a sheet feeding path is provided. The sheet feeding device includes a plurality of feeding rollers to feed a sheet in the sheet feeding path, and a dust remover unit to remove dust adhered onto a surface of the sheet. The dust remover unit includes a dust absorber roller to absorb dust from a surface of the sheet, a dust remover member arranged to be in contact with a surface of the dust absorber roller to remove the dust from the surface of the dust absorber roller, a conveyer member, arranged to be opposed to the dust remover member, to convey the dust removed by the dust remover member, and a cutter member, arranged in an intervening position between the dust remover roller and the conveyer member, to cut the dust removed by the dust remover member into smaller pieces.

12 Claims, 9 Drawing Sheets

SHEET FEEDING DEVICE AND IMAGE FORMING APPARATUS

CROSS REFERENCE TO RELATED APPLICATION

This application claims priority from Japanese Patent Application No. 2007-331606, filed on Dec. 25, 2007, the entire subject matter of which is incorporated herein by reference.

BACKGROUND

1. Technical Field

An aspect of the present invention relates to a dust remover unit for a sheet feeding device and an image forming apparatus.

2. Related Art

Conventionally, a sheet feeder employed in, for example, an image forming apparatus is provided with a dust remover unit, which removes fine paper dust from a surface of a sheet of paper, on a feeding path of the sheet. Such a sheet feeder is illustrated in FIG. 10, which is disclosed in Japanese Patent Provisional Publication No. 2002-108153. The dust remover unit includes, for example, a feed roller 53*a*, a remover roller 54*a*, a sponge member 55*a*, and an auger 56*a*.

The dust adhered onto the surface of the sheet being fed is removed therefrom when the sheet becomes in contact with a surface of the remover roller 54*a*, which is charged triboelectrically by the sponge member 55*a*. The dust is thus electrostatically absorbed by the remover roller 54*a* to be removed from the surface of the sheet.

The dust adhered to the remover roller 54*a* is thereafter scraped off by the sponge member 55*a*. The removed dust retains in space 68*a* between the sponge member 55*a* and the remover roller 54*a*, and develops to make a lump.

When the lump becomes larger to a certain size and falls due to its own weight, the lump can be guided to become in contact with the auger 56*a*. The auger 56*a* can involve the lump of dust to transport the same out of the sheet feeder. Thus, the paper dust is required to be accumulated to make a certain size of a lump in order to be carried by the auger 56*a*.

SUMMARY

In the above configuration, however, the accumulated paper dust may occasionally develop to extend in an axial direction of the remover roller 54*a* without falling to the auger 56*a* and without being carried out.

In view of the above drawbacks, the present invention is advantageous in that a sheet feeding device to feed a sheet in a sheet feeding path is provided. The sheet feeding device includes a plurality of feeding rollers to feed a sheet in the sheet feeding path, and a dust remover unit to remove dust adhered onto a surface of the sheet being fed. The dust remover unit is provided with a dust absorber roller to absorb dust from a surface of the sheet being fed, a dust remover member arranged to be in contact with a surface of the dust absorber roller to remove the dust from the surface of the dust absorber roller, a conveyer member, arranged to be opposed to the dust remover member, to convey the dust removed by the dust remover member, and a cutter member, arranged in an intervening position between the dust remover roller and the conveyer member, to cut the dust removed by the dust remover member into smaller pieces.

According to another aspect of the invention, an image forming apparatus is provided. The image forming apparatus includes an image forming unit to form an image on a surface of a recording sheet, and a sheet feeding device to feed the recording sheet in a sheet feeding path. The sheet feeding device is provided with a sheet separator member to separate the recording sheet from a stack of sheets, a plurality of feeding rollers to feed the recording sheet in the sheet feeding path, and a dust remover unit to remove dust adhered onto a surface of the sheet being fed. The dust remover unit is provided with a dust absorber roller to absorb dust from the surface of the recording sheet being fed, a dust remover member arranged to be in contact with a surface of the dust absorber roller to remove the dust from the surface of the dust absorber roller, a conveyer member, arranged to be opposed to the dust remover member, to convey the dust removed by the dust remover member, and a cutter member, arranged in an intervening position between the dust remover roller and the conveyer member, to cut the dust removed by the dust remover member into smaller pieces.

According to the above configurations, when the dust collected from the surface of the sheet develops to be a lump, the lump can be cut into smaller pieces so that the conveyer member can easily carry the dust outside the dust remover unit. Therefore, the surface of the recording sheet being fed in the sheet feeding path can be cleaned, and the image can be clearly formed on the recording sheet. Therefore, accumulation of the dust within the sheet feeding device can be effectively prevented.

BRIEF DESCRIPTION OF THE ACCOMPANYING DRAWINGS

DETAILED DESCRIPTION

Figure 1:
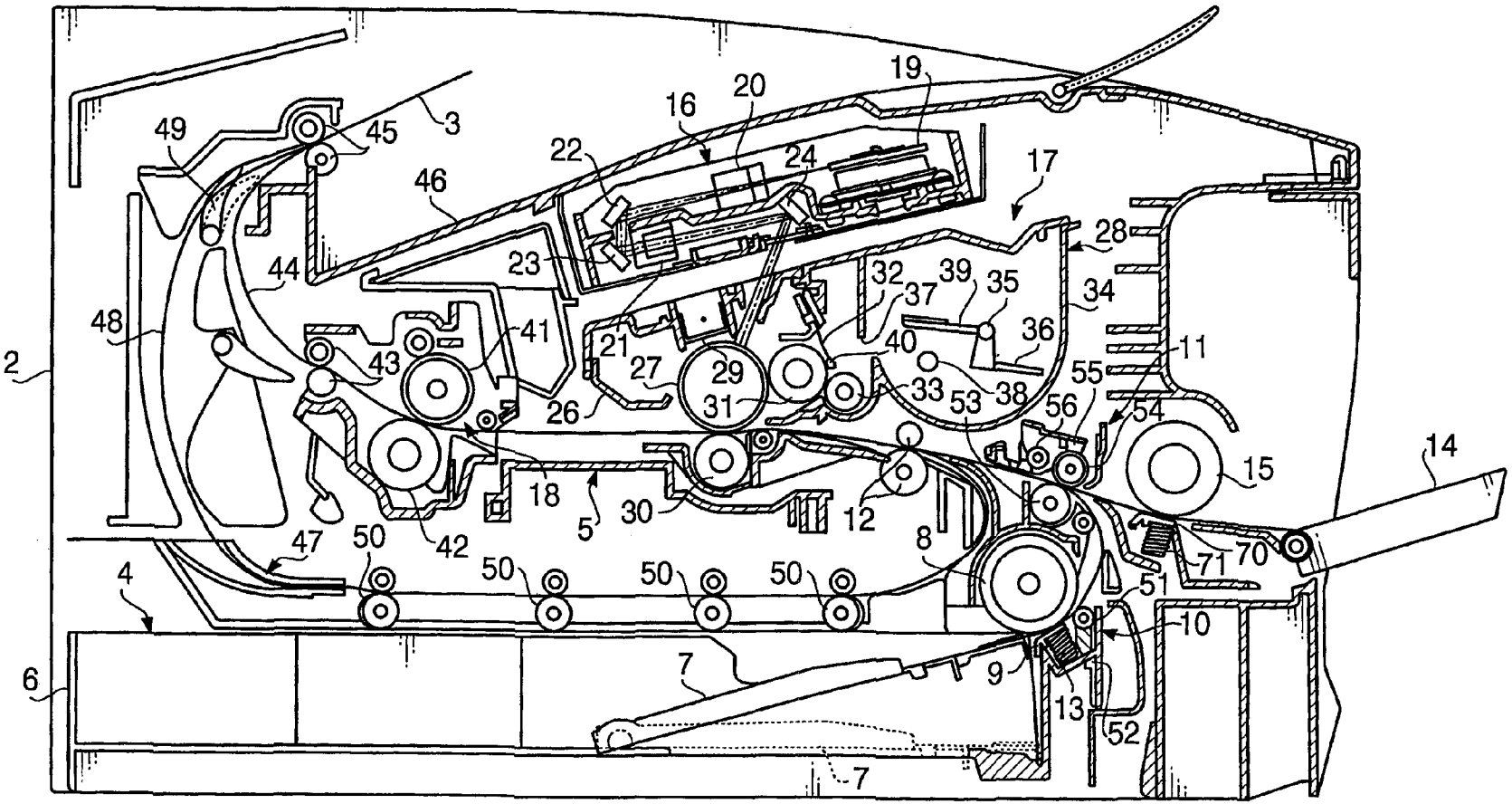
FIG. 1 illustrates a cross-sectional side view of a laser printer according to a first embodiment of the present invention.

Hereinafter, embodiments according to aspects of the present invention will be described with reference to the accompanying drawings. FIG. 1 illustrates a cross-sectional side view of a laser printer 1 according to a first embodiment of the present invention. The laser printer 1 is provided with a feeder unit 4 to feed recording sheets 3 of paper in a predetermined size and an image forming unit 5 to print an image on the recording sheet 3 within a casing 2. The recording sheet 3 is transported in a sheet-feeding path (not shown).

The feeder unit 4 includes a sheet feed tray 6, which is detachably attached onto a bottom of the casing 2 to store a stack of recording sheets 3, a lifting plate 7 provided inside the sheet feed tray 6, a sheet pickup roller 8 and a sheet separation pad 9, which are provided above one end of the sheet feed tray 6. The sheet separation pad 9 has a friction surface (not shown), which can cause friction with the recording sheet 3. Further, a first remover unit 10 is arranged on a downstream side of the sheet-feeding path with respect to the sheet supply roller 8, and a second remover unit 11 is arranged on a further downstream side of the sheet-feeding path with respect to the first remover unit 10. In addition, the feeder unit 4 includes a pair of sheet stop rollers 12, which are arranged on a further downstream side of the sheet-feeding path with respect to the second remover unit 11.

The lifting plate 7 is configured to be pivotable about a rear end thereof (i.e., a far side being far from the sheet pickup roller 8), and a front end thereof (i.e., the other end near to the sheet pickup roller 8) is swingable in a vertical direction. The lifting plate 7 is provided with an expanding spring (not shown), which provides expanding force to the lifting plate 7, on an underside surface. With the expanding force, the stack of recording sheets 3 piled on the lifting plate 7 is maintained lifted upwardly.

The sheet pickup roller 8 and the sheet separation pad 9 are arranged to oppose to each other. A spring 13 is attached to a lower side of the sheet separation pad 9 to provide expanding force to the sheet separation pad 9. Thereby, the sheet separation pad 9 is pressed onto the sheet pickup roller 8 on the friction surface. Thus, when the sheet pickup roller 8 rotates, solely a topmost recording sheet 3 in the stack is picked up by the sheet pickup roller 8, separated from the rest of the stack by the sheet separation pad 9, and fed along the sheet-feeding path. The sheet pickup roller 8 is arranged in a position in which the sheet pickup roller 8 becomes in contact with a widthwise center portion of the recording sheet 3.

The recording sheet 3 is thereafter carried to pass by the first and the second remover units 10 and 11 so that dust adhered on the surface thereof is removed. The recording sheet 3 is further carried to pass between the sheet stop rollers 12. The sheet stop rollers 12 are adapted to adjust timing to feed the recording sheet 3 to the image forming unit 5.

The feeder unit 4 further includes a manual feed tray 14, on which a different-sized recording sheet can be piled, a manual feed roller 15 and a manual feed separation pad 70 to pickup and feed the different-sized recording sheet.

The image forming unit 5 includes a scanner unit 16, a process unit 17, and a fixing unit 18.

The scanner unit 16 is disposed at an upper portion inside the casing 2, and includes a laser emitter (not shown), a rotatable polygon mirror 19, lenses 20 and 21, and reflecting mirrors 22-24. Laser beam emitted from the laser emitter according to predetermined image data is reflected by or transmitted through the polygon mirror 19, the lens 20, the reflecting mirrors 22, 23, the lens 21, and the reflecting mirror 24 as shown in a dotted chain line in FIG. 1. The transmitted laser beam is thus irradiated to scan a surface of a photosensitive drum 27 in the process unit at a high speed.

The process unit 17 is disposed below the scanner unit 16 and includes a drum cartridge 26, which can be detached from the casing 2. The drum cartridge 26 includes the photosensitive drum 27, a developing cartridge 28, a scorotoron charger 29, and a transfer roller 30. The developing cartridge 28 is detachably attached to the drum cartridge 26 and includes a developing roller 31, a toner thickness adjusting blade 32, a toner supplier roller 33, and a toner container 34.

The toner container 34 contains a developing agent, which is positively chargeable and non-magnetic single component type of polymerized toner. The toner may be, for example, polymerized toner which can be achieved by copolymerization of styrene series monomer such as styrene, acrylic monomer such as acrylic acid, alkyl (C1-C4) acrylate, and alkyl (C1-C4) methacrylate in a known polymerization method such as a suspension polymerization method. Such polymerized toner is formed to be spherical and is excellent in fluidity. The polymerized toner is generally blended with a colorant, such as carbon black, and wax. In addition, additive agents such as silica can be provided for improved fluidity. A diameter of such a particle ranges generally between 6 and 10 micrometers.

The toner in the toner container 34 is agitated by an agitator 36, which is supported by a rotation shaft 35 being arranged in a substantial center of the toner container 34. The toner is thus discharged from a toner outlet 37, which is formed on a side of the toner container 34. The toner container 34 is further formed to have a porthole 38, through which a remaining amount of the toner can be viewed. An inner surface of the porthole 38 is wiped by a wiper 39, which is supported by the rotation shaft 35.

A rotatable toner supplier roller 33 is provided on a lower position with respect to the toner outlet 37. The toner supplier roller 33 is disposed so as to oppose to a rotatable developing roller 31 and is mutually abut evenly in parallel with a rotation axis thereof to a surface of the developing roller 31 at a predetermined nip pressure.

The toner supplier roller 33 has a rotation shaft made of a metal and a conductive roller layer made of a foamed material. Meanwhile, the developing roller 31 has a rotation shaft made of a metal and a conductive roller layer made of rubber. On the surface of the developing roller 31, a predetermined level of developing bias to the photosensitive drum 27 is applied.

The toner thickness adjusting blade 32 is arranged in the vicinity of the developing roller 31. The toner thickness adjusting blade 32 is a resilient blade member made of a metal and includes a pressing portion 40, which is made of, for example, insulating silicone rubber, of which cross-section has a shape of a semicircle. The toner thickness adjusting blade 32 is arranged in a position in which the pressing portion 40 is pressed to be contact with the surface of the developing roller 31.

The toner discharged from the toner outlet 37 is received by the toner supplier roller 33 and transferred to the surface of the developing roller 31 as the toner supplier roller 33 rotates. Between the toner supplier roller 33 and the developing roller, the toner being transferred is frictionally charged positively and carried in between the pressing portion 40 of the toner thickness adjusting blade 32 and the developing roller 31, in which the toner is further and substantially charged. Thus, the toner is evenly applied over the surface of the developing roller 31 to form a thin layer.

The photosensitive drum 27 is provided to be rotatable and arranged in parallel with and to be in contact with the developing roller 31. The photosensitive drum 27 includes a drum body (not shown), which is grounded, and a positively chargeable photosensitive layer (not shown), which is made of, for example, polycarbonate, to cover the drum body.

The scorotoron charger 29 is arranged above the photosensitive drum 27 in a position to be substantially apart from the photosensitive drum 27. The scorotoron charger 29 is a corona charger which electrically discharges through electrically charging wires (not shown) made of, for example, tungsten. The surface of the photosensitive drum 27 is uniformly charged with positive polarity to a predetermined level by the scorotoron charger 29.

The surface of the photosensitive drum 27 is exposed to laser beam that scans the surface of the photosensitive drum 27 in parallel with the rotation axis according to image data, and a latent image is formed on the surface of the photosensitive drum 27, as regions where the latent image is formed gains a lower potential due to an effect of the laser beam. As the photoconductive drum 27 with the latent image on the surface thereof is rotated, the toner positively charged on the surface of the developing roller 31 is transferred and adhered to the lower-potential region, which corresponds to the latent image on the surface of the photosensitive drum 27. Thus, the latent image is developed to be a reverse image.

A transfer roller 30 is arranged immediately below the photosensitive drum 27 to be in parallel with the rotation axis of the photoconductive drum 27 and is rotatably supported by the drum cartridge 26. The transfer roller 30 includes a rotation shaft (not shown) made of a metal and a roller layer (not shown) made of conductive rubber to cover the rotation shaft. On the surface of the transfer roller 30, a predetermined level of transfer bias of a reverse polarity to the photosensitive drum 27 is applied so that the toner image developed on the surface of the photosensitive drum 27 is transferred to the surface of the recording sheet 3 to form the normal image when the recording sheet 3 is carried in between the photosensitive drum 27 and the transfer roller 30.

The fixing unit 18 is disposed on a downstream side of the sheet feed path with respect to the process unit 18. The fixing unit 18 includes a heat roller 41, a pressure roller 42 which is pressed to be in contact with the heat roller 41, and feed rollers 43, which is positioned a downstream side with respect to the heat roller 41 and the pressure roller 42. The heat roller 41 is made of a metal and is provided with a halogen lamp to serve as a heat source. The toner image transferred onto the recording sheet 3 in the process unit 17 is thermally fixed thereto when the recording sheet 3 is fed between the heat roller 41 and the pressure roller 42. The recording sheet 3 is thereafter fed along a discharging path 44 by the feed rollers 43. The recording sheet 3 fed along the discharging path 44 is passed to a pair of discharge rollers 45 to be discharged out of the laser printer 1. The discharged recording sheet 3 is received by a discharge tray 46.

The laser printer 1 according to the present embodiment is configured such that the developing roller 31 collects residual toner remaining on the surface of the photosensitive drum 27 after the toner is transferred to the recording sheet 3 (i.e., so-called cleanerless system). According to the system, a cleaning device such as a blade to wipe the surface of the photosensitive drum 27 and a container to store the collected toner can be omitted so that an overall configuration of the laser printer 1 can be simplified and downsized.

The laser printer 1 according to the present embodiment is further provided with a reverse-feeding unit 47, which enables forming images on both sides of the recording sheet 3. The reverse-feeding unit 47 includes the pair of discharge rollers 45, a reverse-feeding path 48, a flapper 49, and a plurality of pairs of reverse-feeding rollers 50.

The discharge rollers 45 can be rotated in normal directions and reverse directions, and the rotational directions are switchable. The discharge rollers 45 are rotated in the normal directions when the recording sheet is fed to be discharged out of the laser printer 1, and in the reverse directions when the recording sheet 3 is reversed.

The reverse-feeding path 48 extends in a substantially vertical (up-and-down) direction so that the recording sheet 3 can be transported therealong from the discharge rollers 45 to a pair of the reverse-feeding rollers 50 on the left-hand end in FIG. 1.

The flapper 49 is pivotably provided in the vicinity of a portion in which the discharging path 44 and the reverse-feeding path 48 merge. The flapper 49 can be pivoted about an axis (not shown) to switch feeding paths of the recording sheet 3 according to excitation and de-excitation of a solenoid (not shown). That is, the flapper 49 is shifted upwardly to a substantially upright position as shown in a solid line in FIG. 1 when the recording sheet 3 is fed in the normal direction. Meanwhile, the flapper is reclined as shown in a broken line in FIG. 1 when the recording sheet 3 is reversed at the discharge rollers 45 and fed in the reverse-feeding direction.

The plurality of reverse-feeding rollers 50 are arranged above the sheet feed tray 6 and aligned substantially horizontally.

After an image is formed on one side of the recording sheet 3, and another image is to be formed on the other side of the recording sheet 3, the reverse-feeding unit 47 is activated. That is, the recording sheet 3 with the image formed on one side is transported along the discharging path 44 by the feed rollers 43 to the discharge rollers 45, the discharge-rollers 45 are rotated in the normal directions with the recording sheet 3 nipped therebetween to transport the recording sheet 3 outwardly toward the discharge tray 46. The discharge rollers 45 stop rotating when a greater part of the recording sheet 3 is fed outside the laser printer 1 and the recording sheet 3 is nipped by the discharge rollers 45 at a rear end portion thereof. There, the discharge rollers 45 are rotated in the reverse directions. Further, substantially simultaneously, the flapper 49 is pivoted to be reclined as shown in the broken line so that the recording sheet 3 can be transported in the reverse-feeding path 48. The flapper 49 is returned to the upright position when the reverse transportation of the recording sheet 3 to the reverse-feeding path 48 completes. The recording sheet 3 is carried to the reverse-feeding rollers 50, which further transport the recording sheet 3 to the sheet stop rollers 12. It is to be noted that the recording sheet 3 is reversed to face upward the back surface, on which no image has yet been formed, in between the sheet stop rollers 12 and the reverse-feeding rollers 50 at the most downstream side (i.e., the right-hand side in FIG. 1). Thus, the recording sheet 3 is fed to the image forming unit 5, in which the image is formed on the back side of the recording sheet 3.

Next, the first and the second remover units 10, 11 will be described. The first remover unit 10 is disposed in the vicinity of the sheet separation pad 9 and includes a feeder-side remover roller 51 and a feeder-side sponge member 52, which is arranged below the feeder-side remover roller 51 in a position to be in contact with the feeder-side remover roller 51.

The feeder-side remover roller 51 includes a shaft (not shown), a roller layer, of which surface can be electrically charged, and made of, for example, fluorine resin. The feeder-side remover roller 51 is positioned to be in contact with the image forming surface (i.e., the side which becomes in contact with sheet separation pad 9 and with the photosensitive drum 27 in the process unit 17).

The feeder-side sponge member 52 is made of a material (e.g., polyurethane foam) which can frictionally charge the feeder-side remover roller 51 and pressed to be in contact with the surface of the feeder-side remover roller 51 so that fine paper dust adhered to the surface of the feeder-side remover roller 51 is removed by the feeder-side sponge member 52 and the surface of the feeder-side remover roller 51 can be frictionally charged. The feeder-side remover roller 51 is formed to have a width being substantially larger than a width of the sheet separation pad 9 for effective removability.

Thus, when the image forming surface of the recording sheet 3 becomes in contact with the feeder-side remover roller 51, which is frictionally charged by the feeder-side sponge member 52, the fine paper dust adhered onto the image forming surface of the recording sheet 3 is statically absorbed by the feeder-side remover roller 51. The paper dust stuck onto the surface of the feeder-side remover roller 51 is thus removed by the feeder-side sponge member 52 and collected in a bottom portion of the casing 2. The feeder-side sponge member 52 is formed to have a width being substantially larger than the width of the feeder-side remover roller 51 for effective removability.

Figure 2:
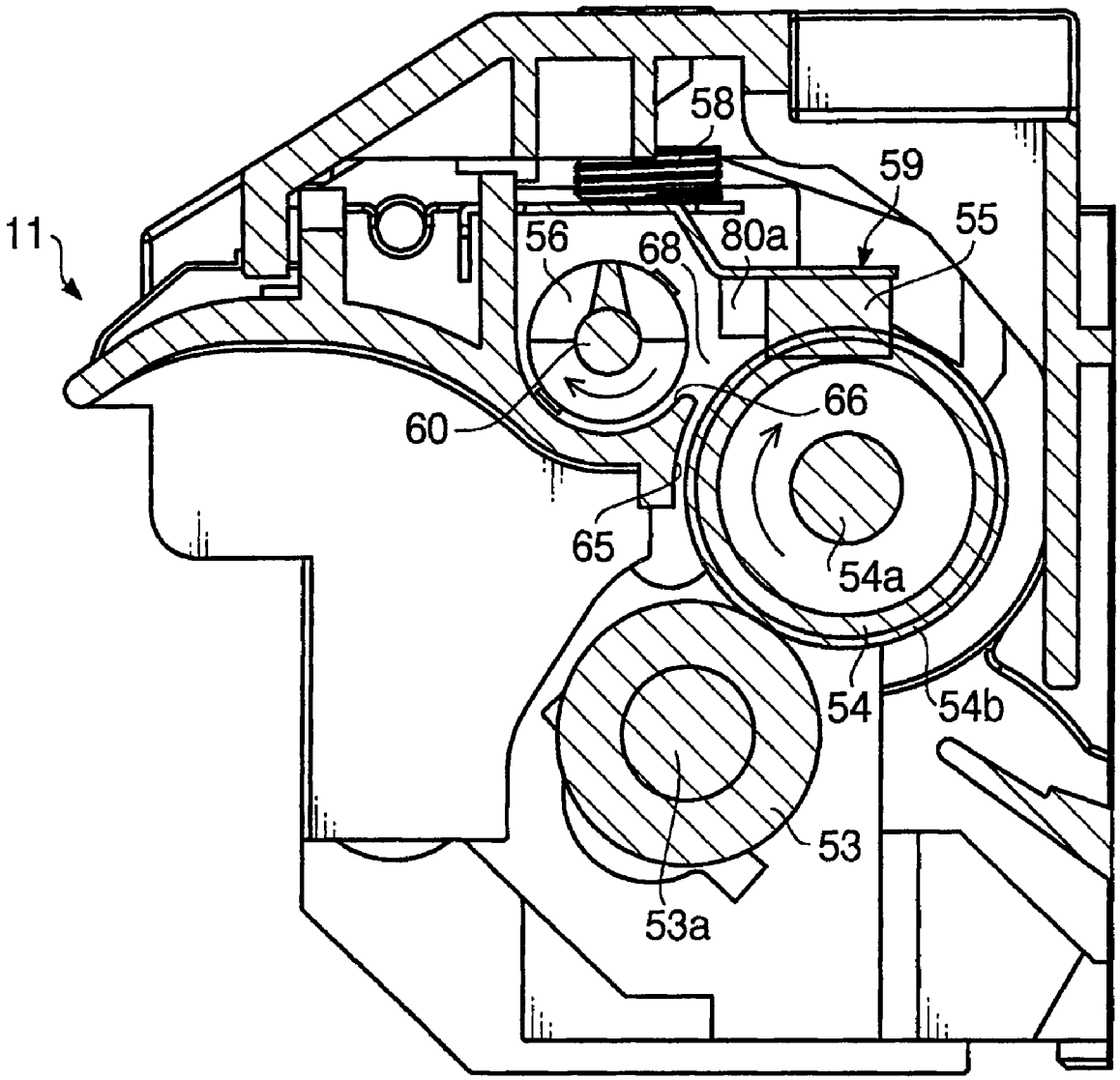
FIG. 2 illustrates a cross-sectional side view of a second remover unit of the laser printer according to the first embodiment of the present invention.

The second remover unit 11 is disposed above the sheet pickup roller 8 and on the upstream side with respect to the sheet stop roller 12. FIG. 2 illustrates a cross-sectional side view of the second remover unit 11 according to the first embodiment of the present invention. The second remover unit 11 includes a carrier roller 53, an absorber roller 54, a sponge member 55, an auger 56, and a guide member 65. On the upstream side and in the vicinity of the second remover unit 11, a guide roller (not shown) to guide the recording sheet 3 in between the carrier roller 53 and the absorber roller 54 is provided.

The carrier roller 53 is formed to have a width being substantially larger than a width of the recording sheet 3 and connected with a motor (not shown), which provides rotating force to the carrier roller 53, at one end of a rotation shaft 53*a* thereof.

The absorber roller 54 is positioned above and in parallel with the carrier roller 53. The absorber roller 54 is arranged to be in contact with the carrier roller 53. The absorber roller 54 is formed to have a width being substantially larger than the width of the recording sheet 3 and configured to rotate in a direction indicated by an arrow (i.e., a clockwise direction) in FIG. 2 according to the rotation of the carrier roller 53. The absorber roller 54 includes a shaft 54*a*, a roller layer 54*b*, of which surface can be electrically charged, and made of, for example, fluorine resin. The absorber roller 54 is positioned to be in contact with the image forming surface of the recording sheet 3.

The sponge member 55 is disposed above the absorber roller 54 and is made of a material (e.g., polyurethane foam) which can frictionally charge the absorber roller 54. The sponge member 55 is attached to a lower surface of a holder frame 59, which is pressed downward by a spring 58. Accordingly, the sponge member 55 is pressed to be in contact with the surface of the absorber roller 54. The sponge member 55 is formed to have a width being substantially larger than the width of the absorber roller 54 so that the entire width of the absorber roller 54 can be wiped and frictionally charged.

Figure 6:
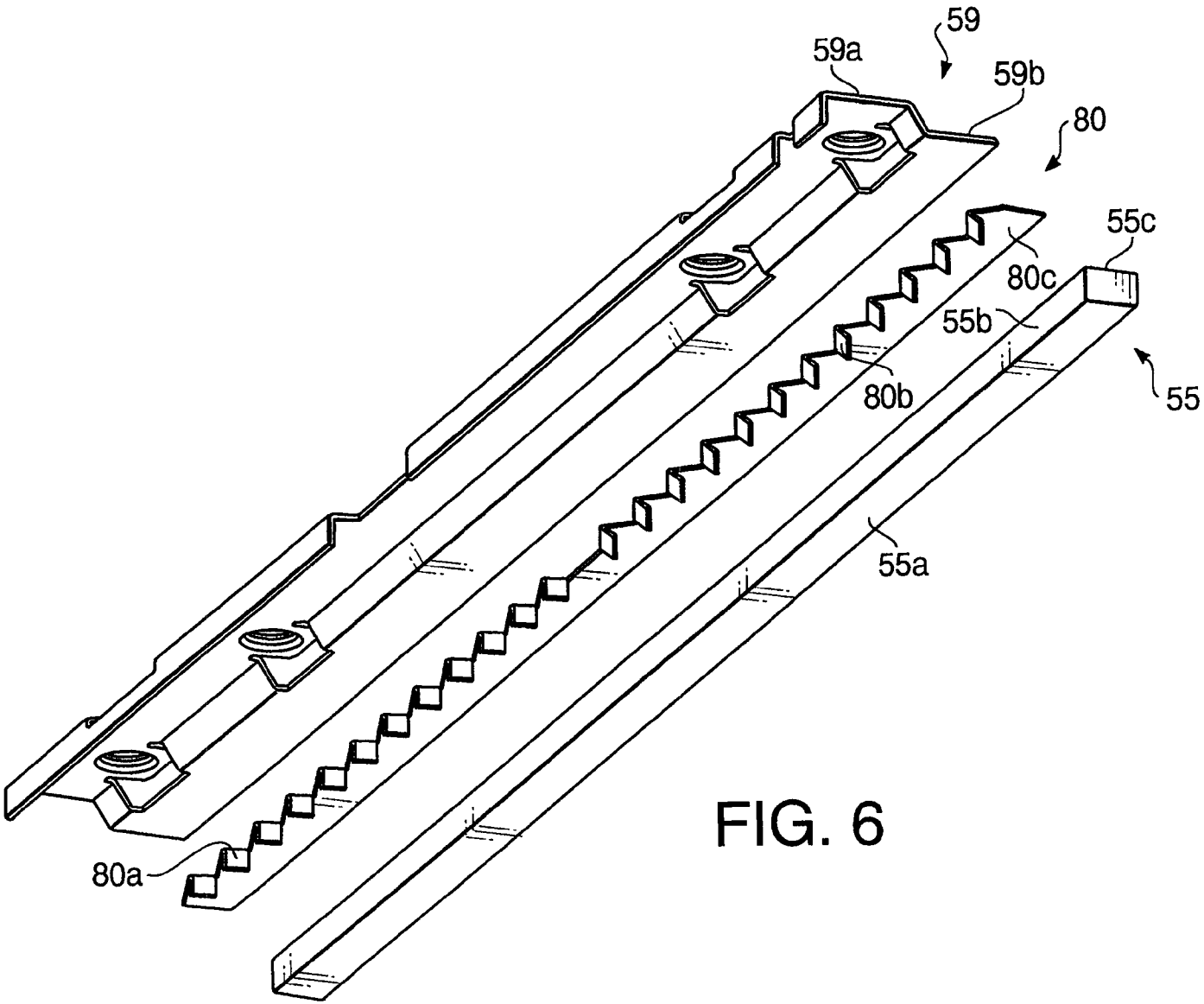
FIG. 6 is an exploded view of a sponge member, a cutter piece, and a holder frame of the second remover unit according to the first embodiment of the present invention.

The sponge member 55 has a contacting surface 55*a*, which is to be in contact with the absorber roller 54 when assembled in the second remover unit 11, a lateral surface 55*b*, which is to face the auger 56 when assembled, and an upper surface 55*c*, which is to face the cutter piece 80 when assembled (see FIG. 6).

Figure 3:
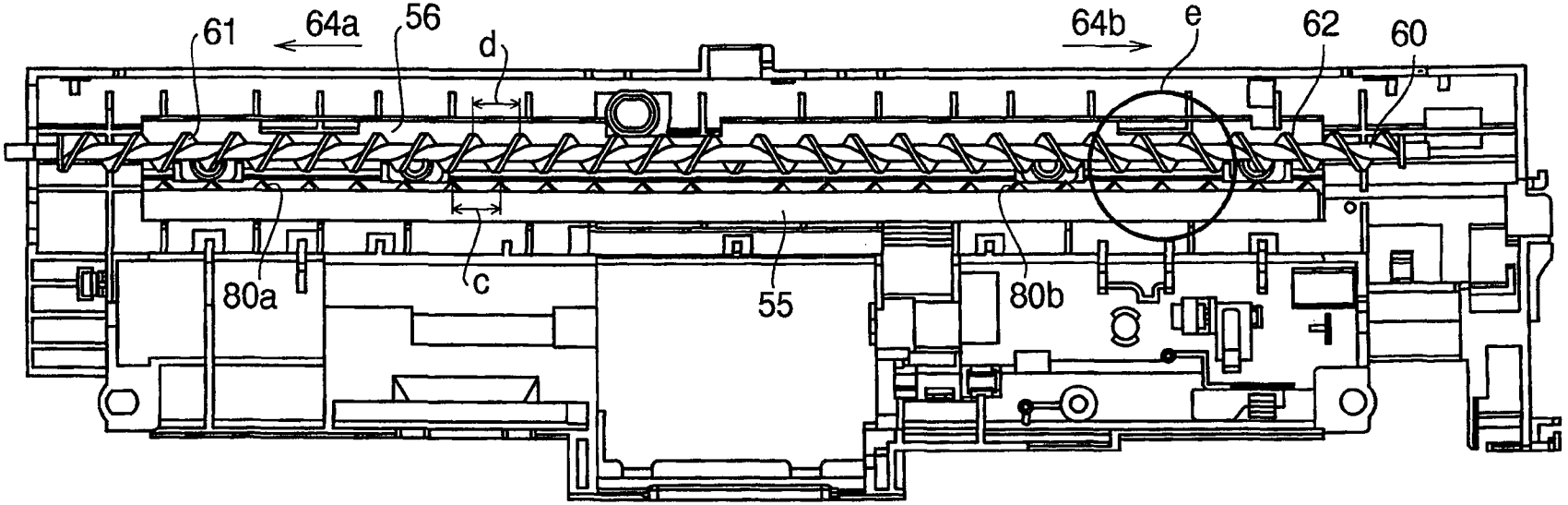
FIG. 3 illustrates a plane view of the second remover unit according to the first embodiment of the present invention.

The auger 56 is arranged in parallel with the absorber roller 54. The auger 56 is positioned to be apart at a predetermined from the absorber roller 54 to form retaining space 68, in which the paper dust is temporarily stored, along with a guide member 65. FIG. 3 illustrates a plane view of the second remover unit 11 having the auger 56 according to the first embodiment of the present invention. It is to be noted that the absorber roller 54 is omitted in FIG. 3 for simplicity in explanation. The auger 56 includes a shaft 60, a first spiral portion 61 on a left-hand side and a second spiral portion 62 on a right-hand side in FIG. 3. The first spiral portion 61 and the second spiral portion 62 are divided at a longitudinal center of the shaft 60.

The shaft 60 is formed to have a length being substantially smaller than a width of the casing 2 but substantially larger than the width of the sponge member 55. The second remover unit 11 is disposed in the laser printer 1 to have the shaft 60 to be parallel with the axis 54*a* of the absorber roller 54. The shaft 60 is provided with an auger drive gear (not shown) at one end thereof so that driving force provided by a motor (not shown) is conveyed to the shaft 60 through the auger drive gear and the shaft 60 is rotated in the clockwise direction as indicated by the arrow in FIG. 2.

The shaft 60 is provided with two portions, the first spiral portion 61 and the second spiral portion 61, which are divided at a longitudinal center of the shaft 60. The first spiral portion 61 is formed on the left-hand half of the shaft 60 as shown in FIG. 3. As the shaft 60 rotates, the paper dust removed by the absorber roller 54 and remaining in the vicinity of the first spiral portion 61 is conveyed along the first spiral portion 61 in a direction indicated by an arrow 64*a*. Meanwhile, the second spiral portion 62 is formed on the right-hand half of the shaft 60 as shown in FIG. 3. The spirals of the first spiral portion 61 and the second spiral portion 62 are formed to coil in opposite directions from each other. Therefore, as the shaft 60 rotates, the paper dust removed by the absorber roller 54 and remaining in the vicinity of the second spiral portion 62 is conveyed along the second spiral portion 62 in a direction indicated by an arrow 64*b*, which is an opposite direction from the direction 64*a*. Thus, the paper dust guided by the auger 56 is separated at the substantial center of the auger 56 to be conveyed in the opposite directions 64*a*, 64*b*.

Figure 5:
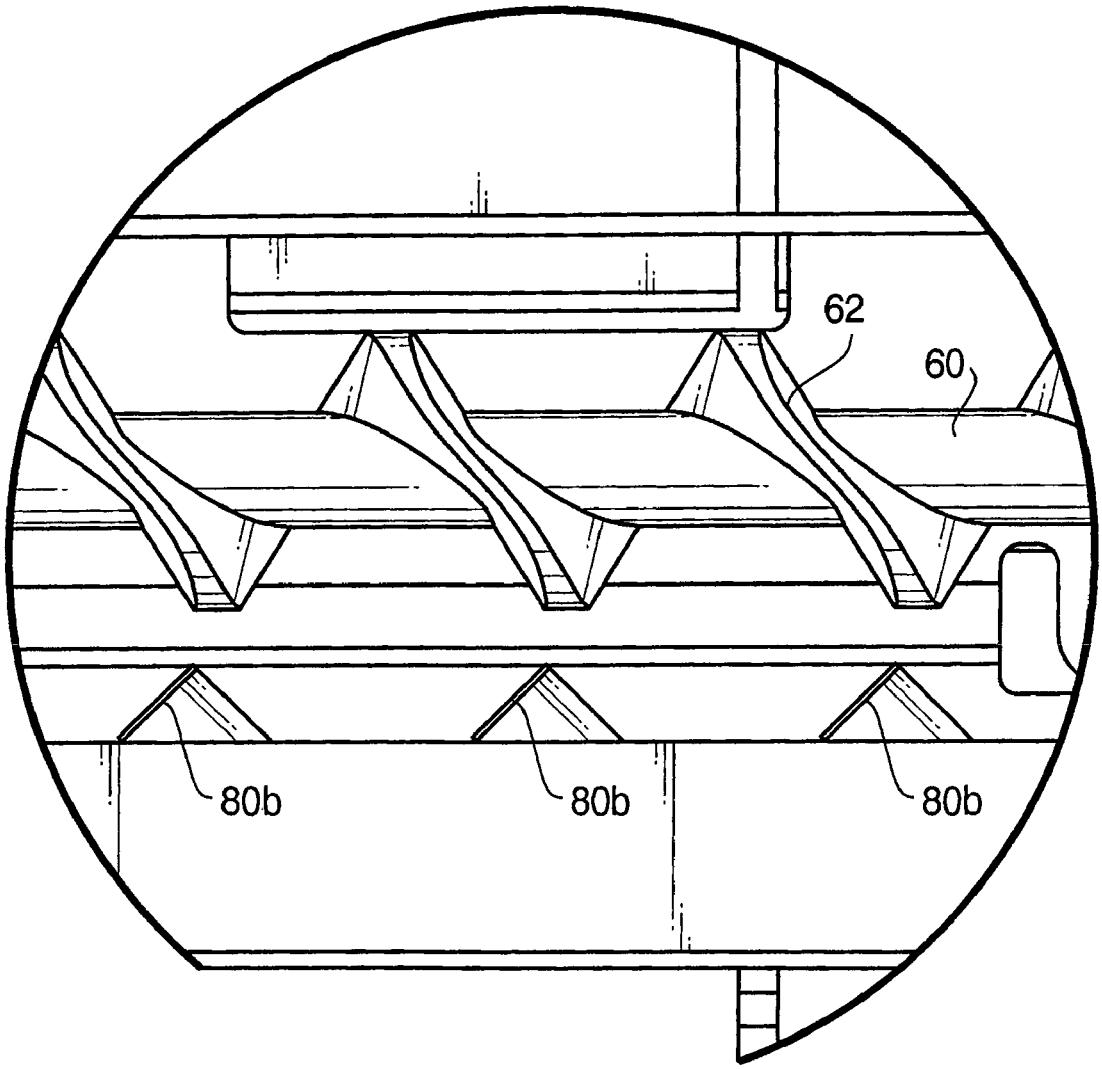
FIG. 5 is an enlarged view of a portion e shown in FIG. 3 illustrating the second remover unit according to the first embodiment of the present invention.

FIG. 5 is an enlarged view of a portion e of the second remover unit 11 shown in FIG. 3 illustrating the second remover unit according to the first embodiment of the present invention. The second remover unit 11 is provided with a cutter piece 80 having thin blade portions 80*a*, 80*b* in an intervening position between the sponge member 55 and the auger 56. FIG. 6 is an exploded view of the sponge member 55, the cutter piece 80, and the holder frame 59 of the second remover unit 11 according to the first embodiment of the present invention. The cutter piece 80 further includes a thin base plate 80*c*, which extends in the width direction of the sponge member 55 (i.e., a perpendicular direction with respect to the sheet-feeding path). The blade portions 80*a*, 80*b* are arranged to project from the base plate 80*c*. Each of the blade portions 80*a*, 80*b* is formed to have a substantial shape of a square. The blade portions 80*a* are postured to incline outward with respect to a longitudinal center of the cutter piece 80, which corresponds to the longitudinal center of the shaft 60 of the auger 56 when the cupper piece 80 and the auger 56 are assembled, toward the direction 64*a*, and the blade portions 80*b* are postured to incline outward to the direction 64*b*. The blade portions 80*a* are arranged in positions corresponding to the first spiral portion 61, when the cutter piece 80 is assembled in the second remover unit 11, and the blade portions 80*b* are arranged in positions corresponding to the second spiral portion 62.

Each of the blade portions 80*a*, 80*b* is arranged on the cutter piece 80 at an interval c (FIG. 3). It is to be noted that the interval c is substantially equivalent to an interval d between edges of the spirals in the first and the second spiral portions 61, 62. An angle of the inclination substantially corresponds to inclination of the spiral portions 61, 62 with respect to the axial direction of the shaft 60. The cupper piece 80 including the blade portions 80*a*, 80*b* and the base plate 80*c* is made of, for example, poly-ethylene-terephthalate film.

The holder frame 59 extends in the width direction of the sponge member 55 and includes a supporting portion 59*b*, by which the base plate 80*c* of the cutter piece 80 and the sponge member 55 are attached, for example, adhesively. The holder frame 59 further includes an arm portion 59*a*.

Figure 7:
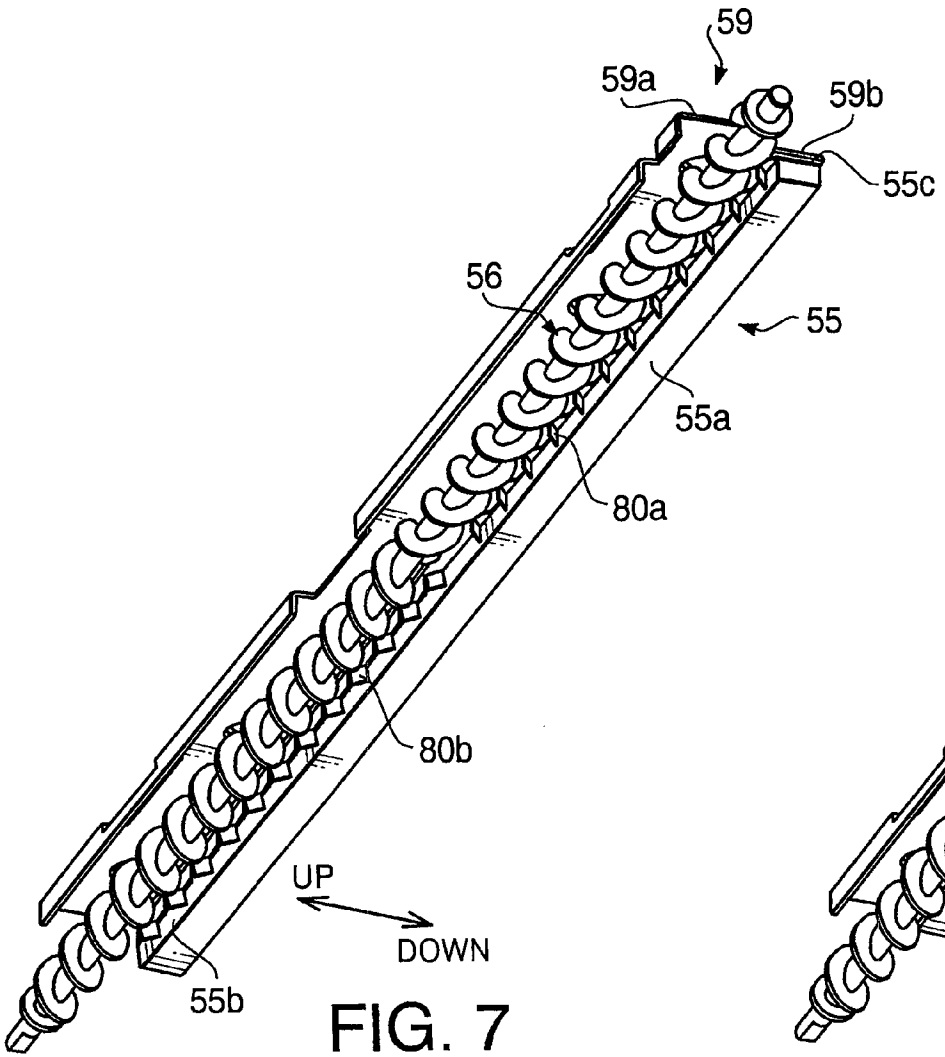
FIG. 7 is an assembled view of the sponge member, the cutter piece, and the holder frame of the second remover unit 11 according to the embodiment of the present invention.

FIG. 7 is an assembled view of the sponge member 55, the cutter piece 80, and the holder frame 59 of the second remover unit 11 according to the embodiment of the present invention. When the sponge member 55, the cutter piece 80, and the holder frame 59 are assembled, the cutter piece 80 is held to be set in an intervening position between the holder frame 59 and the sponge member 55. Specifically, an entire upper surface of the base plate 80*c* of the cutter piece 80 is attached, for example adhesively, to the supporting portion 59*b* of the holder frame 59, and a lower surface, i.e., the other side of the base plate 80*c*, excluding a portion in which the blade portions 80*a*, 80*b* are arranged, is attached, for example adhesively, the upper surface 55*c* of the sponge member 55. In this arrangement, the base plate 80*c* of the cutter piece 80 is nipped between the supporting portion 59*b* of the holder frame 59 and upper surface 55*c* of the sponge member 55. Meanwhile, the blade portions 80*a*, 80*b* drooping from the base plate 80*c* are positioned between the auger 56 and the sponge member 55.

The guide member 65 (see FIG. 2) is disposed in between the absorber roller 54 and the auger 56 and in a relatively lower position with respect to the sponge member 55. The guide member 65 includes a receiving portion 66, which receives the paper dust falling from the cupper piece 80.

Figure 4:
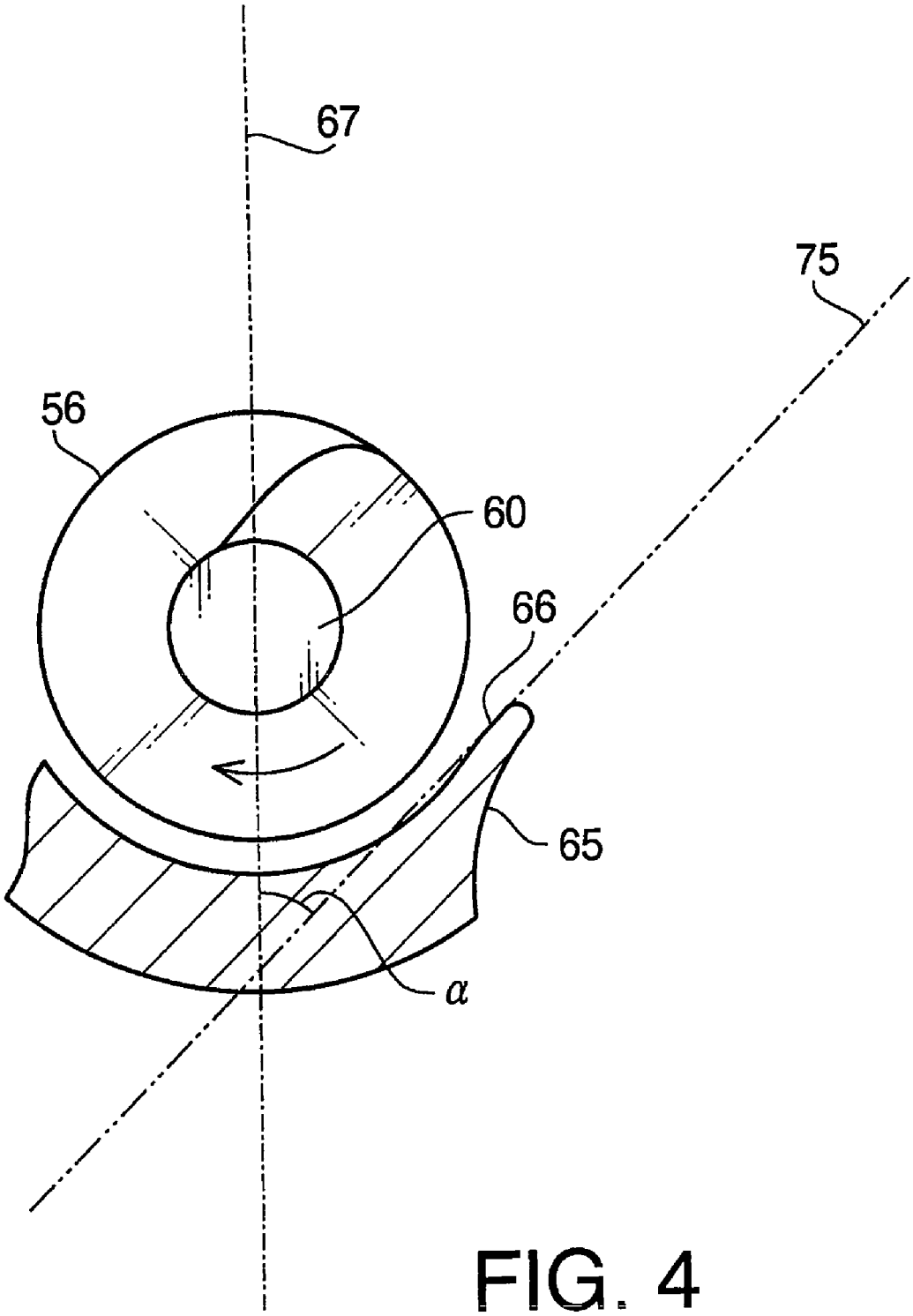
FIG. 4 illustrates a positional relation between the auger and a receiving portion of a guide member in the second remover unit according to the first embodiment of the present invention.

FIG. 4 illustrates a positional relation between the auger 56 and the receiving portion 66 of the guide member 65 in the second remover unit 11 according to the first embodiment of the present invention. The receiving portion 66 is formed to have inclination (as represented by a double-dotted line 75) being angled at an angle alpha ($\alpha$) to range from 0 to 45 degrees, more preferably, from 30 to 45 degrees, with respect to a vertical line 67 (as indicated by a single-dotted line), which passes through the axis of the shaft 60 of the auger 56. It is to be noted that when the angle alpha is greater than 45 degrees, the guide member 65 may retain the paper dust on the receiving portion 66. Meanwhile, when the angle alpha is smaller than 0 degree, the guide member 65 may not be capable of receiving the paper dust. Further, when the angle alpha is smaller than 30 degrees, space between the receiving portion 66 and the auger 56 may be too broad, and the received paper dust may not be properly guided to the auger 56. In the present embodiment, the angle alpha is assumed to be 45 degrees.

Next, referring to FIGS. 2 and 7, an operation to discharge the paper dust by the second remover unit 11 will be described. As the recording sheet 3 is carried along the sheet-feeding path, the paper dust adhered to the image forming surface of the recording sheet 3 is absorbed by the absorber roller 54, which is frictionally charged by the sponge member 55, in the second remover unit 11.

The paper dust thus adhered to the surface of the absorber roller 54 is scraped off by the sponge member 55. As the absorber roller 54 rotates in the clockwise direction in FIG. 2, the paper dust scraped off of the absorber roller 54 remains in the retaining space 68, which is defined by the lateral surface 55*b* of the sponge member 55 and the absorber roller 54. The paper dust is thus accumulated in the retaining space 68 to make a lump.

When the lump develops larger to become contact with the blade portions 80*a*, 80*b*, the lump is cut into smaller pieces. In this regard, it is to be noted that a size of each smaller piece of the lump corresponds to the interval c (FIG. 3) between the blade portions 80*a*, 80*b*, which also corresponds to the interval d between the edges of the spirals in the first and the second spiral portions 61, 62. Therefore, the smaller pieces of lumps can be easily conveyed by the auger 56 to be discharged.

It is to be noted that the blade portions 80*a*, 80*b* are postured to incline outward with respect to the axial center of the cutter piece 80. The angles of the inclination correspond to the directions in which the auger 56 carries the pieces of paper dust. Therefore, the lump can be cut into easily-conveyable shapes.

Further, the portions in which the blade portions 80*a*, 80*b* are provided in the cutter piece 80 substantially corresponds to the entire width of the sponge member 55. Therefore, the entire lump of paper dust can be cut into smaller pieces.

The smaller pieces of paper dust thereafter fall on the receiving portion 66 of the guide member 65 due to their own weights and received by the receiving portion 66 to be guided therealong to the auger 56. It is to be noted that when the paper dust is lumped into smaller pieces, the paper dust can be easily carried by the auger 56, and diffusion of fine paper dust within the casing 2 can be prevented.

The paper dust guided to the auger 56 is involved in between the edges of the spirals in the first spiral portion 61 and the second spiral portion 62 as the shaft 60 rotates in the direction indicated by the arrow (FIG. 2). The paper dust involved in the first spiral portion 61 is thus carried in the direction 64*a*, and the paper dust involved in the second spiral portion 62 is carried in the direction 64*b* to be discharged (see FIG. 3). In this regard, it is to be noted that the auger 56 is positioned to be apart from the absorber roller 54 to have a predetermined gap therebetween. Therefore, when the auger 56 carries the paper dust in the respective directions, the paper dust can be prevented from becoming in contact with the absorber roller 54 to adhere again to the surface of the absorber roller 54, and the paper dust can be effectively removed and carried to be discharged.

Although an example of carrying out the invention has been described, those skilled in the art will appreciate that there are numerous variations and permutations of the dust remover unit for a sheet feeder and an image reading apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 8:
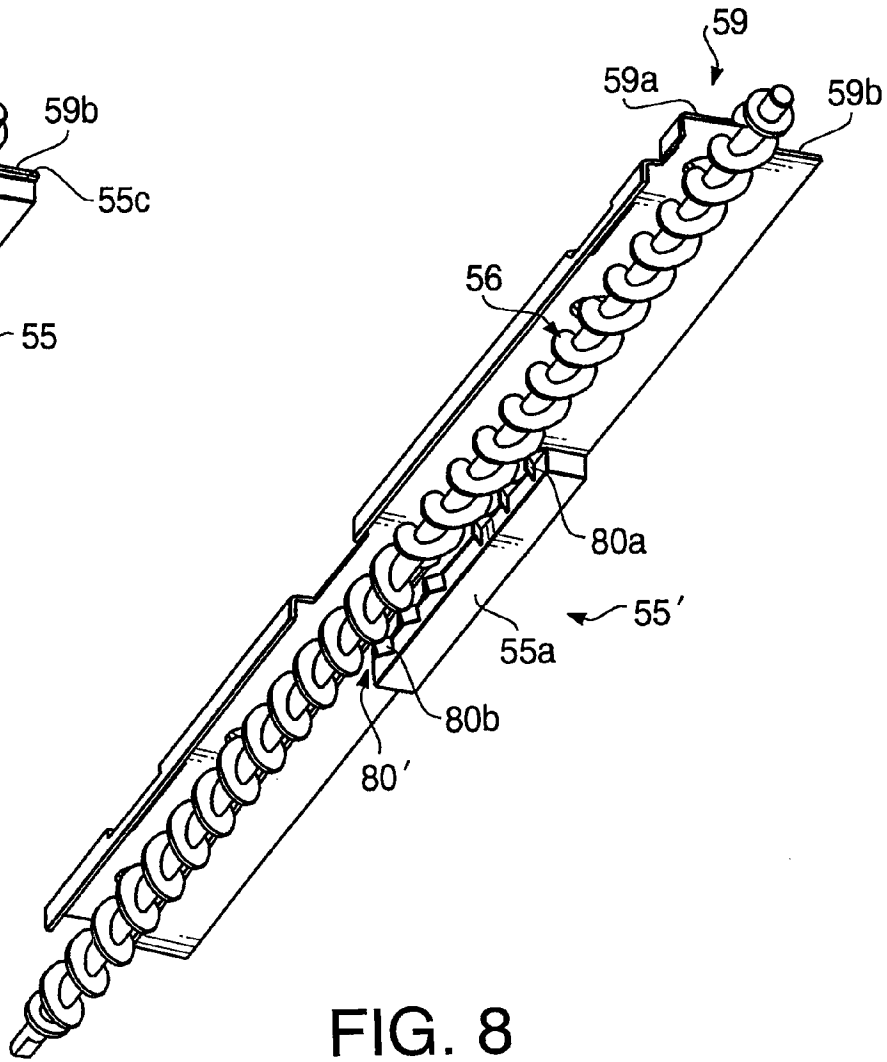
FIG. 8 illustrates a remover unit of the laser printer according to a second embodiment of the present invention.

For example, the sponge member 55 may not necessarily have the width being substantially larger than the width of the recording sheet 3. FIG. 8 illustrates a part of the second remover unit 11 with a sponge member 55' and a cutter piece 80' having smaller widths according to a second embodiment of the present invention. It is to be noted that the sponge member 55' is provided only for removing the paper dust on the axially-central portion of the recording sheet. The paper dust can be produced due to the friction between the recording sheet 3 and the sheet pickup roller 8, and the recording sheet 3 and the sheet separation pad 9. Therefore, the sponge member 55' may have a substantial width to scrape the portion which becomes contact with the sheet pickup roller 8 and the sheet separation pad 9. Even with this configuration, the paper dust collected and developed in the retaining space 68 can be cut into smaller pieces with the blade portions 80*a*, 80*b* and carried to be discharged by the auger 56.

Figure 9:
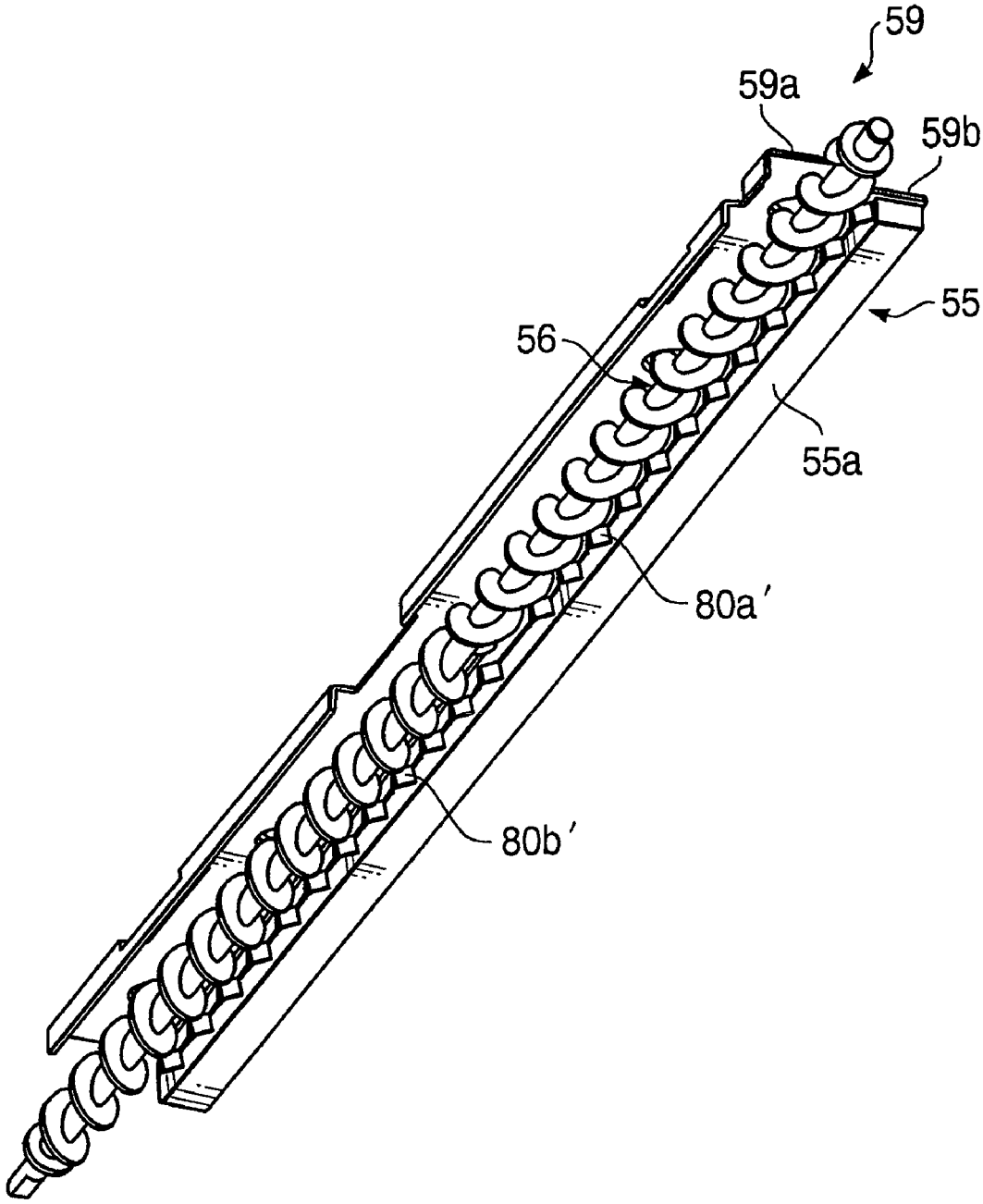
FIG. 9 illustrates a cutter piece with blade portions which are postured to be perpendicular to a lateral surface of the sponge member according to a third embodiment of the present invention
Figure 10:
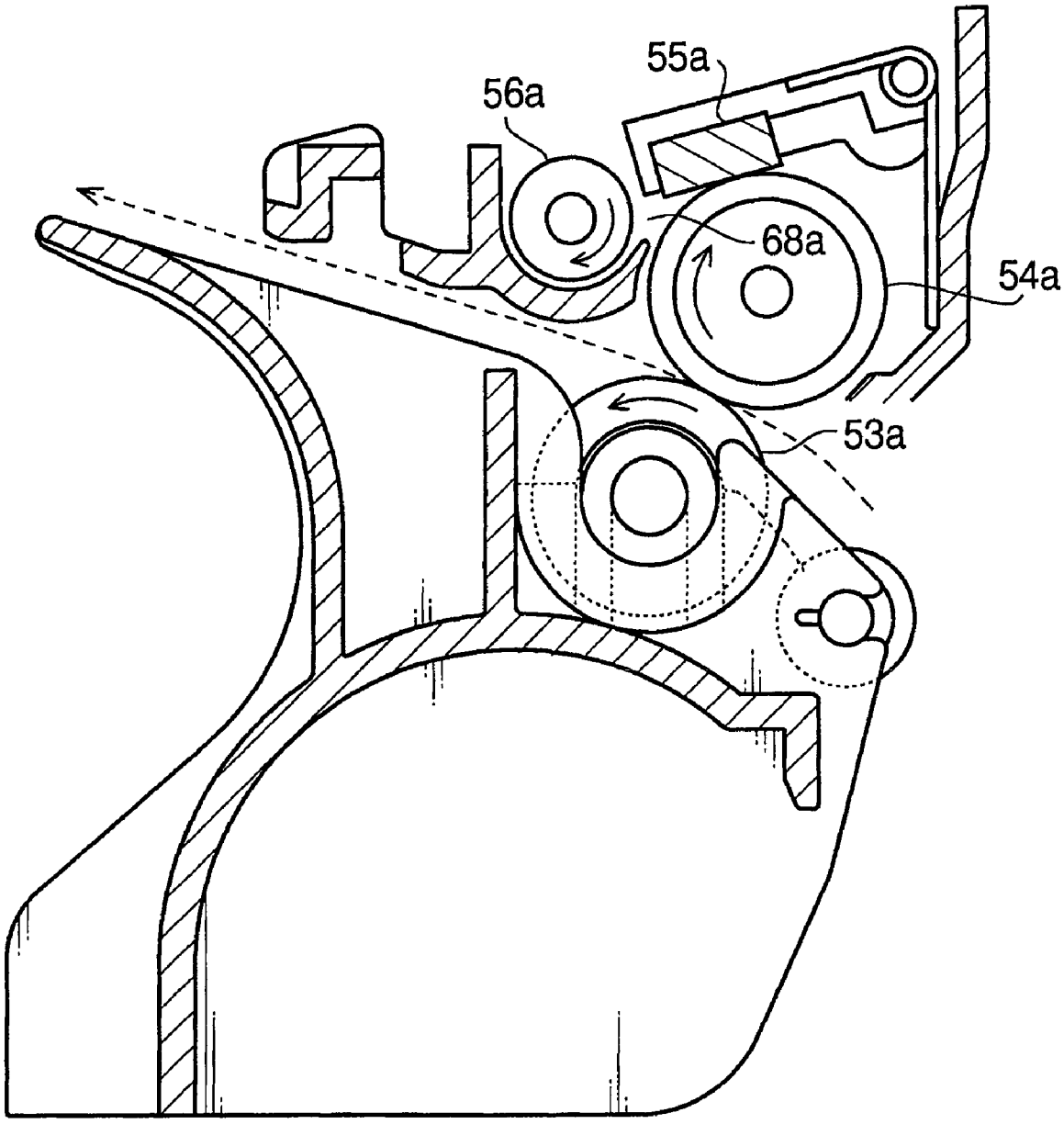
FIG. 10 illustrates a conventional dust remover unit of a printing apparatus.

For another example, the blade portions 80*a*, 80*b* may not necessarily be inclined outward but may be postured perpendicularly to the lateral surface 55*b* of the sponge member 55. FIG. 9 illustrates the cutter piece 80 with blade portions 80*a*', 80*b*' which are postured to be perpendicular to the lateral surface 55*b* of the sponge member 55 according to a third embodiment of the present invention. Even with this configuration, the lump of the paper dust can be cut into smaller pieces and effectively carried to be discharged by the auger 56.

Further, the intervals between the blade portions 80*a*, 80*b* respectively may not necessarily be equivalent to the intervals between the edges of the spirals in the first spiral portion 61 and the second spiral portion 62 respectively. At least one blade portion to cut the lump into smaller pieces arranged in a different position, which may not correspond to the edge of the spiral, can still assist the auger 65 to carry the paper dust to be discharged.

Furthermore, the material to form the cutter piece 80 may not necessarily be poly-ethylene-terephthalate film, but may be other material such as a metal.

What is claimed is:

1. A sheet feeding device to feed a sheet in a sheet feeding path, comprising:

a plurality of feeding rollers to feed a sheet in the sheet feeding path; and a dust remover unit to remove dust adhered onto a surface of the sheet being fed, wherein the dust remover unit is provided with:

a dust absorber roller to absorb dust from a surface of the sheet being fed;

a dust remover member arranged to be in contact with a surface of the dust absorber roller to remove the dust from the surface of the dust absorber roller;

a conveyer member, arranged to be opposed to the dust remover member, to convey the dust removed by the dust remover member; and a cutter member, arranged in an intervening position between the dust remover member and the conveyer member, to cut the dust removed by the dust remover member into smaller pieces, wherein the dust remover member is formed to have a predetermined width, which extends in a direction perpendicular to the sheet feeding path;

wherein the conveyer member is formed to extend to be wider than the predetermined width of the dust remover member, and is an auger screw, which includes a rotatable shaft and spirals with edges to coil around the shaft;

wherein the dust removed by the dust remover member is conveyed by rotation of the conveyer member along the spirals; and wherein the cutter member is formed to have a width which is at least equivalent to the predetermined width of the dust remover member, and includes a plurality of blade portions, which are arranged at predetermined intervals on a base plate, the predetermined intervals corresponding to intervals between edges of the spirals.

2. The sheet feeding device according to claim 1, wherein the conveyer member is provided with two spirals, which are divided at a reference position of the shaft and coil in two opposing directions around the shaft to convey the dust respectively outwardly with respect to the reference position of the shaft.

3. The sheet feeding device according to claim 1, wherein the blade portions are postured to incline outward with respect to a reference position of the cutter member, which corresponds to the reference position of the shaft.

4. The sheet feeding device according to claim 1, wherein the blade portions are postured to incline outward with respect to a longitudinal center of the cutter member.

5. The sheet feeding device according to claim 1, wherein the dust remover member includes a sponge member to be in contact with the surface of the absorber roller to remove the dust therefrom and a supporting portion to support the sponge member; and wherein the cutter member is nipped between the sponge member and the supporting member of the dust remover member at one side; and wherein the blade portions arranged on the other side of the cutter member are drooping downward between the conveyer member and the sponge member.

6. The sheet feeding device according to claim 1, wherein the cutter member is made of poly-ethylene-terephthalate film.

7. An image forming apparatus, comprising:

an image forming unit to form an image on a surface of a recording sheet; and a sheet feeding device to feed the recording sheet in a sheet feeding path, wherein the sheet feeding device is provided with:

a sheet separator member to separate the recording sheet from a stack of sheets;

a plurality of feeding rollers to feed the recording sheet in the sheet feeding path; and a dust remover unit to remove dust adhered onto a surface of the sheet being fed, wherein the dust remover unit is provided with:

a dust absorber roller to absorb dust from the surface of the recording sheet being fed;

a dust remover member arranged to be in contact with a surface of the dust absorber roller to remove the dust from the surface of the dust absorber roller;

a conveyer member, arranged to be opposed to the dust remover member, to convey the dust removed by the dust remover member; and a cutter member, arranged in an intervening position between the dust remover member and the conveyer member, to cut the dust removed by the dust remover member into smaller pieces;

wherein the dust remover member is formed to have a predetermined width, which extends in a direction perpendicular to the sheet feeding path;

wherein the conveyer member is formed to extend to be wider than the predetermined width of the dust remover member, and is an auger screw, which includes a rotatable shaft and spirals with edges to coil around the shaft;

wherein the dust removed by the dust remover member is conveyed by rotation of the conveyer member along the spirals; and wherein the cutter member is formed to have a width which is at least equivalent to the predetermined width of the dust remover member, and includes a plurality of blade portions, which are arranged at predetermined intervals on a base plate, the predetermined intervals corresponding to intervals between edges of the spirals.

8. The sheet feeding device according to claim 7, wherein the conveyer member is provided with two spirals, which are divided at a reference position of the shaft and coil in two opposing directions around the shaft to convey the dust respectively outwardly with respect to the reference position of the shaft.

9. The sheet feeding device according to claim 7, wherein the blade portions are postured to incline outward with respect to a reference position of the cutter member, which corresponds to the reference position of the shaft.

10. The sheet feeding device according to claim 7, wherein the blade portions are postured to incline outward with respect to a longitudinal center of the cutter member.

11. The sheet feeding device according to claim 7, wherein the dust remover member includes a sponge member to be in contact with the surface of the absorber roller to remove the dust therefrom and a supporting portion to support the sponge member; and wherein the cutter member is nipped between the sponge member and the supporting member of the dust remover member at one side; and wherein the blade portions arranged on the other side of the cutter member are drooping downward between the conveyer member and the sponge member.

12. The sheet feeding device according to claim 7, wherein the cutter member is made of poly-ethylene-terephthalate film.

* * * * *